United States Patent [19]

Solloway

[11] Patent Number: 4,627,613

[45] Date of Patent: Dec. 9, 1986

[54] HYDRODYNAMIC JUMPER

[76] Inventor: Daniel S. Solloway, 1315 18th St., Woodward, Okla. 73801

[21] Appl. No.: 624,123

[22] Filed: Jun. 25, 1984

Related U.S. Application Data

[63] Continuation-in-part of Ser. No. 411,853, Aug. 26, 1982, Pat. No. 4,458,896, which is a continuation-in-part of Ser. No. 310,788, Oct. 13, 1981, Pat. No. 4,416,451, which is a continuation-in-part of Ser. No. 79,966, Sep. 28, 1979, Pat. No. 4,311,306.

[51] Int. Cl.[4] ..... A63B 21/20

[52] U.S. Cl. ..... 272/116; 272/1 B; 272/71

[58] Field of Search ..... 272/71, 116, 130, 1 B, 272/93, 119; 434/254; 441/55, 59, 60

[56] References Cited

U.S. PATENT DOCUMENTS

| | | | |
|---|---|---|---|
| 1,329,660 | 2/1920 | Kaye | 272/71 X |
| 3,142,485 | 7/1964 | Jacobsen | 272/1 B X |
| 3,424,133 | 1/1969 | Brady | 441/60 X |
| 3,517,930 | 6/1970 | Jacobsen | 272/71 |
| 3,584,870 | 6/1971 | Garst | 272/116 |
| 3,786,526 | 1/1974 | Ausseil | 272/71 X |
| 3,913,907 | 10/1975 | Baker | 272/71 X |
| 4,302,007 | 11/1981 | Oprean et al. | 272/71 X |

FOREIGN PATENT DOCUMENTS

| | | | |
|---|---|---|---|
| 1306873 | 9/1962 | France | 434/254 |
| 2327805 | 5/1977 | France | 272/71 |
| 2421637 | 12/1979 | France | 272/71 |

*Primary Examiner*—Richard J. Apley
*Assistant Examiner*—Robert W. Bahr
*Attorney, Agent, or Firm*—Thomas W. Tolpin

[57] ABSTRACT

A hydrodynamic jumper which can be interchangeably used by men, women, and children alike in the water without substantial structural modification by simply adjusting its shoulder straps. The hydrodynamic jumper permits a large range of movement and controlled use of resistive forces. The hydrodynamic jumper includes an annular hydrodynamic member and shoulder straps which carry the annular hydrodynamic member about the waist of the user. In the illustrative embodiments, the annular member is semi-torroidal, trough-shaped or flat. The jumper can have blades, baffles, bumps, slits, or deflectors for increased hydrodynamic fluid resistance and pressure. The jumper can also have foldable hinged sections for compact storage, shipment, and handling.

9 Claims, 41 Drawing Figures

100
102
104
106
108
110
112
114
116
118
120
122
124
126a
126b
128
130
132
134
136
138
140
142
144
146
148
149
150
151
152
154
160
162
164
164a
166
170
172
174

Fig. 14.
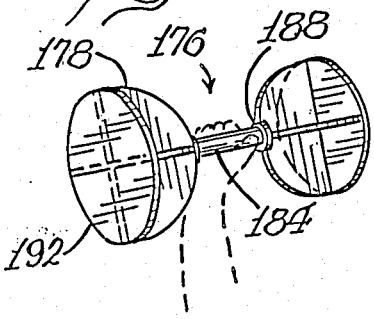
Fig. 15.
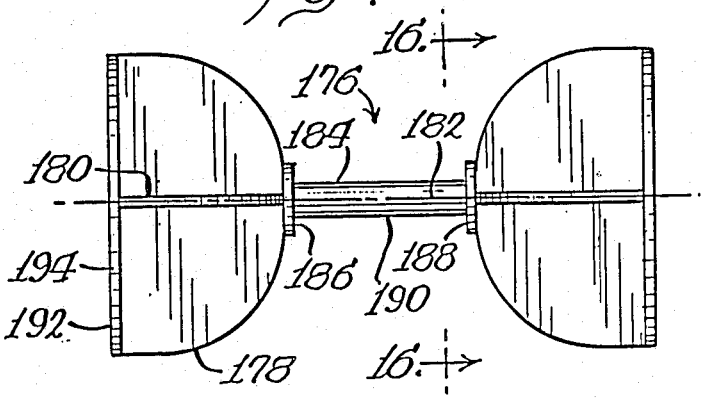
Fig. 16.
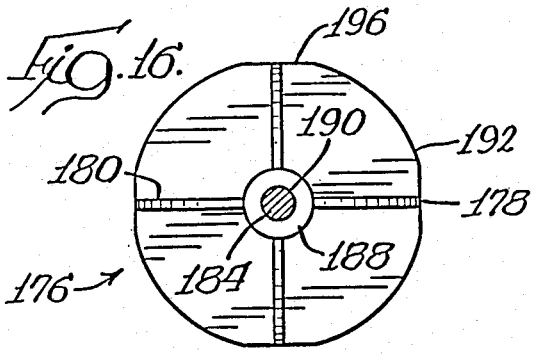
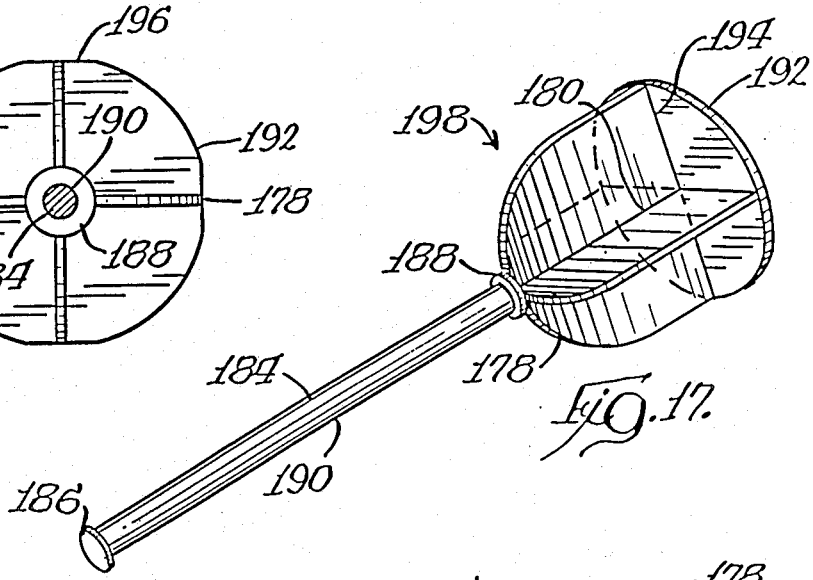
Fig. 17.
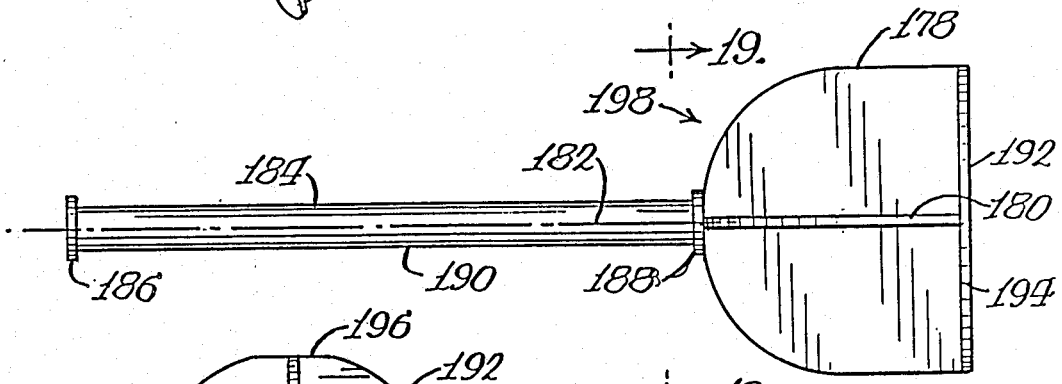
Fig. 18.
Fig. 19.
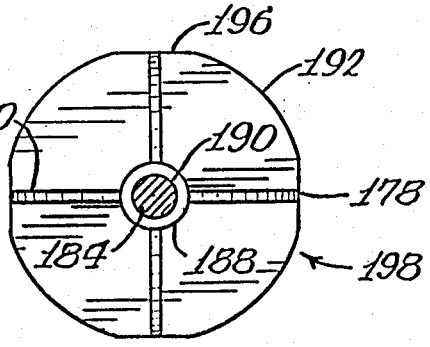

HYDRODYNAMIC JUMPER

CROSS REFERENCES TO RELATED APPLICATIONS

This application is a continuation-in-part of Ser. No. 411,853 now U.S. Pat. No. 4,458,896, filed Aug. 26, 1982, issued July 10, 1984 for an Aquatic Exercise Assembly, which is a continuation-in-part of Ser. No. 310,788 now U.S. Pat. No. 4,416,451, filed Oct. 13, 1981, issued Nov. 23, 1983, and Ser. No. 79,966 now U.S. Pat. No. 4,311,306, filed Sept. 28, 1979, isued Jan. 19, 1982 for an Aquatic Exercise Assembly.

BACKGROUND OF THE INVENTION

This invention relates to an exercise assembly, and more particularly, to an exercise assembly for use in water.

Over the years, a variety of weight lifting and aquatic exercise devices have been developed. Typifying these weight lifting and exercise devices and other devices are those shown in U.S. Pat. Nos. 373,692; 654,097; 660,962; 717,041; 1,366,200; 1,676,689; 2,143,337; 3,260,523; 3,427,022; 3,671,988; 3,834,696; 3,889,306; 3,984,102; 4,029,312; 4,227,273; U.S. Design Pat. Nos. Des. 1,906,056 and 495,769; German Pat. No. 351,627; and Italian Pat. No. 615,402. These weight lifting and exercise devices have met with varying degrees of success.

Many of the conventional weight lifting and exercise devices, however, are relatively awkward, cumbersome, and complex, and are not suitable for interchangeable use by men, women, and older children alike having different physical capabilities and strengths without extensive modifications. For example, barbells, as well as pulley and rope exercise devices have various size weights which usually must be adjusted, such as by adding or removing the weights from the exercise device, to accommodate the exercise device to the particular lifting strength and physical capability of the weight lifter. Furthermore, many of these conventional exercise devices exert an excess amount of torque and torsion (twist) on the joints of the user and are, therefore, not usually suitable for many types of physical therapy.

It is therefore desirable to provide an exercise assembly which overcomes most, if not all, of the above disadvantages.

SUMMARY OF THE INVENTION

An improved aquatic exercise assembly provides a hydrodynamic aquatic jumper, squatter or hoop, for use in repetitively squatting and doing knee bends underwater to strengthen muscles, improve muscle tone and enhance muscular coordination of the legs and other parts of the body. Advantageously, the aquatic exercise assembly is readily useable by me, women and children alike, having different strengths and physical capabilities without substantial modification.

The aquatic exercise assembly is particularly useful in strengthening legs and for physical therapy, because the hydrodynamic resistive forces which it exerts on the legs and joints of the user or patient can be readily controlled by the user or a physical therapist, by simply varying the acceleration, momentum or rate of ascent or descent of the exercise assembly to the desired amount through the water. Desirably, the aquatic exercise assembly is easy to use, effective and relatively simple in design and construction for economy of manufacture.

To this end, the aquatic exercise assembly has an annular hydrodynamic member and adjustable should assembly that is operatively connected to the annular member to support the annular member from the user's shoulders generally about the user's waist. The annular member has a generally downwardly facing surface which descendingly engages the water and creates a downward pressure head when the annular member is lowered in the water, and a generally upwardly facing surface for ascendingly engaging the water and creating an upward pressure head when the annular member is raised in the water.

The annular member can have a convex bottom surface and a concave or flat top surface. Polygonal and other shaped annular members can also be used. The annular member preferably includes a plurality of mannually grippable handles, although the exercise assembly can be grabbed by the straps, if desired.

In one form the annular member has a semi-torroidal bottom surface so that it is bagel-shaped or donut-shaped as viewed from the bottom.

In another form, the annular member is trough-shaped with trapezoidal or flared sidewalls.

In still another form, the annular member is formed with a series of flow passageways, such as a plurality of holes, apertures, slots or rectangular or oval openings, and a set of flaps which pivotally cover the flow passageways. When the exercise assembly is moved downwardly through the water, the flaps pivot to a generally upright open position allowing water to pass through the passageways in order to minimize downward hydrodynamic resistance. When the exercise assembly is moved upward in the water, the flaps close to a generally horizontal position covering the passageways in order to maximize upward hydrodynamic resistance.

The above hydrodynamic aquatic jumpers can have water-resistant or turbulent blades, baffles, deflectors, slits or wavy, jagged, bumpy, or curved surfaces for enhanced hydrodynamic resistance. The hydrydynamic jumper can also be collapsible with folded hinged sections for easier compact storage, shipment, and handling.

Other types of aquatic exercise assemblies are also disclosed.

A more detailed description of the invention is provided in the following description and appended claims taken in conjunction with the accompanying drawings.

BRIEF DESCRIPTION OF THE DRAWINGS

FIG. 14 is a perspective view of another barbell-like blade type of aquatic exercise assembly;

FIG. 15 is an enlarged front view of the aquatic exercise assembly of FIG. 14;

FIG. 16 is a cross-sectional view of the aquatic exercise assembly of FIG. 14 taken substantially along line 16—16 of FIG. 15;

FIG. 17 is a perspective view of another aquatic exercise assembly;

FIG. 18 is a front view of the aquatic exercise assembly of FIG. 17;

FIG. 19 is a cross-sectional of the aquatic exercise assembly of FIG. 17 taken substantially along line 19—19 of FIG. 18;

DETAILED DESCRIPTION OF THE PREFERRED EMBODIMENTS

Figure 1:
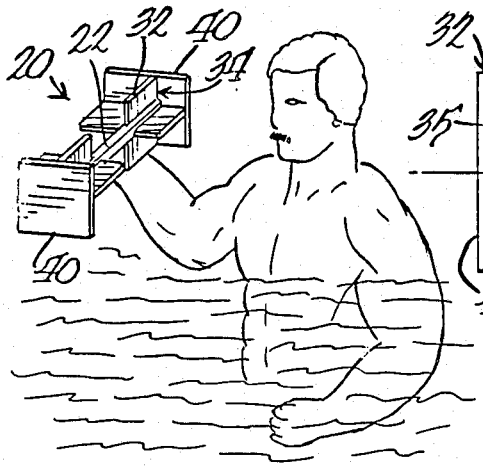
FIG. 1 is a perspective view of a barbell-like fin type of aquatic exercise assembly being lowered into the water by a weight lifter.
Figure 2:
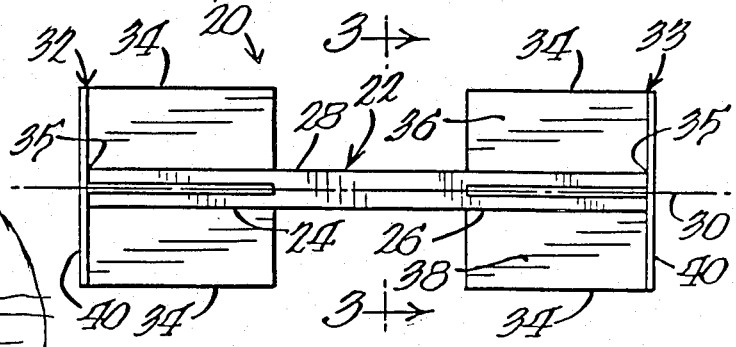
FIG. 2 is an enlarged front view of the aquatic exercise assembly of FIG. 1.
Figure 3:
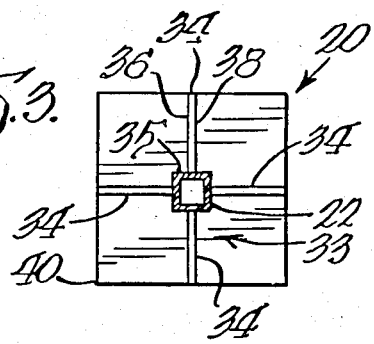
FIG. 3 is a cross-sectional view of the aquatic exercise assembly of FIG. 1 taken substantially along line 3—3 of FIG. 2.

Referring now to FIG. 1–3 of the drawings, a barbell-like blade or fin type of aquatic exercise assembly 20, sometimes referred to as an aquatic exerciser, is shown for use in water by weight lifters, patients, parapalegics, and other persons desirous of strengthening their muscles, improving their muscle tone, and enhancing their muscular coordination. Exercise assembly 20 is helpful to improve the cardiovascular system and general well being of the user.

Structurally, exercise assembly 20 has a water-engageable shaft, rod or bar 22 that is formed of a substantially water-impermeable and impact-resistant material, such as light weight aluminum or plastic. Shaft 22 has a left-hand blade-receiving portion 24 (FIG. 2) at one end, a right-hand blade-receiving portion 26 at the other end, and a manually grippable handle portion 28 that is positioned intermediate and between and which connects blade-receiving portions 24 and 26. In the embodiment shown, shaft 22 has a square cross-section to facilitate gripping and is tubular to minimize weight and reduce construction costs.

In the illustrative embodiment, shaft 22 is generally rigid or stiff with the handle portion 28 spanning a length somewhat greater than the span of two hands so that it can be gripped by either one or two hands. While the illustrated embodiment is the preferred type of barbell-like exercise assembly, in some circumstances, it may be desirable that the shaft be solid or of a different shape, such as being cylindrical with knurled or other finger gripping portions, or that the shaft be more flexible or that the handle portion be somewhat larger or smaller.

Shaft 22 is elongated and is generally straight or linear so as to extend along axis 30 (FIG. 2). The shaft has a width taken in a radial direction that is generally transverse to the axis 30.

Shaft 22 also serves to rigidify and connect a pair of diametrically opposed hydrodynamic resistance assemblies 32 and 33 that are coaxially connected and secured to blade-receiving portions 24 and 26, respectively, of the shaft. Each hydrodynamic resistance assembly 32 and 33 has a plurality of angularly disposed water-engageable radial blades or fins 34. Blades 34 extend radially from the shaft and serve to deflect water and create a pressure head and fluid resistance to water flow as the shaft is moved in or through the water. Blades 34 are generally planar or flat and are formed of the same material as the shaft. Preferably, there are at least two pairs of diametrically opposed blades 34 at each end of the shaft. In the illustrative embodiment, each of the two sets of diametrically opposed blades are positioned generally perpendicular or at right angles to each other and each of the adjacent blades 34 cooperate with each other to define an angular aquatic pocket 35 for cuppingly engaging water as shaft 22 is moved in the water.

Each of the radial blades 34 has a pair of opposed generally flat water-impingement surfaces 36 and 38 which have a generally rectangular cross-sectional area. In use, one of the water-impingement surfaces 36 or 38 is positioned generally normal or perpendicular to the direction of movement of the shaft 22 to hydrodynamically engage the water as the shaft is moved in the water. Water-impingement surfaces 36 and 38 span a radial width or height that is substantially greater than the width of the shaft 22, taken in a direction transverse to axis 30, to increase or intensify the water resistance of the water-impingement surfaces. The water resistance (resistive forces) exerted by blades 34 as shaft 22 is moved in the water can be increased by increasing the radial span or height of the blades 34 and thereby enlarging the effective cross-sectional area that is positioned generally normal to the direction of movement of the shaft 22.

The blades 34 of each of the hydrodynamic resistance assemblies 32 and 33, respectively, are spaced an effective distance from the handle portion 28 of the shaft 22 to exert a hydrodynamic torque on the handle portion as the shaft is moved in or through the water so as to strengthen the muscles of the user of the aquatic exercise assembly 20. If the user's hand is held in the middle of the shaft and the shaft is rotated or pivoted, the torque exerted by the blades extending from the left hand side of the shaft will counterbalance and offset the torque exerted by the blades extending from the right hand side of the shaft 22.

A transverse blade or fin 40 is secured to each end of shaft 22 at a position generally normal to and abuttingly engaging radial blades 34. Transverse blades 40 create an axial pressure head and fluid resistance to the water when shaft 22 is moved axially in or through the water. In the illustrative embodiment, transverse blade 22 is positioned axially outward of radial blades 32, and is generally rectangular and generally planar or flat. In some circumstances, it may be desirable to position the transverse blades axially inwardly of the radial blades 34.

While the number of blades illustrated in FIGS. 1–3 are preferred, it may be desirable in some circumstances to have more or less blades at each end of the shaft or at different angles, or that the blades be curved or twisted or of a different shape or formed of a different material.

In use, the aquatic exercise assembly 20 is moved or swung in the water at a selected acceleration and momentum to create the desired resistance, torque and torsion upon the arms of the person using the exercise assembly.

Figure 4:
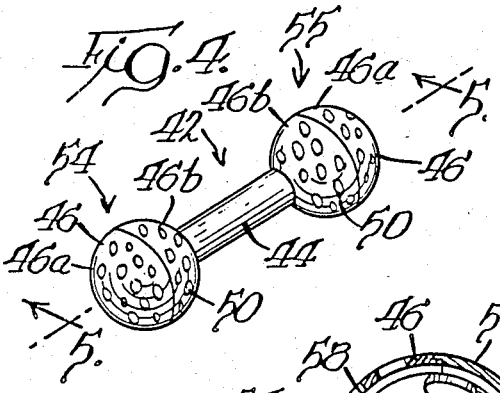
FIG. 4 is a perspective view of a barbell-like ball type of aquatic exercise assembly.
Figure 5:
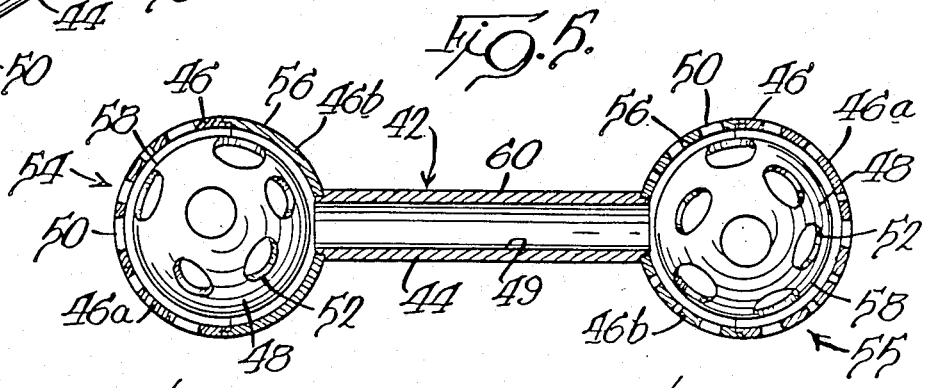
FIG. 5 is an enlarged cross-sectional view of the aquatic exercise assembly of FIG. 4 taken substantially along line 5—5 of FIG. 4.

Referring now to FIGS. 4 and 5, a barbell-like ball-type of aquatic exercise assembly 42 is shown for use in water. Ball-type exercise assembly 42 is similar to blade-type exercise assembly 20 (FIGS. 1–3) except that each of the ends of the water-engageable shaft or rod 44 securely carries a generally spherical water-engageable outer hollow shell 46 that houses an internal hollow ball 48 and shaft 44 defines a fluid-flow passageway 49 in fluid communication with the outer shells 46 and internal balls 48. Each outer shell 46 is coaxially and fixedly connected to the end of bar 24 and defines a plurality of fluid-flow apertures or holes 50 therein. Outer shell 46 is preferably made of two semi-spherical complementary cup-like parts 46*a* and 46*b* (FIG. 4) which are detachably connected to each other, such as by complementary threads, snaps or tabs.

Internal ball 48 is hydrorotatably positioned within its associated shell 50 and defines a plurality of fluid-flow openings or holes 52 that are positioned in fluid communication with shell apertures 50 to accommodate passage of water through the internal ball 48 and outer shell 46 as the exercise assembly 42 is moved in the water. Each internal ball 48 and its associated outer shell 46 cooperate with each other to provide a hydrodynamic resistance assembly 54 or 55 that deflects water flow as shaft 44 and exercise assembly 42 are moved in the water.

Outer shell 46 and internal ball 48 are each preferably formed of a substantially water-impermeable impact-resistant material, such as aluminum or impact resistant plastic, as is shaft 44. Outer shell 46 and internal ball 48 each provide a water-impingement surface 56 and 58 (FIG. 5), respectively, with a circular cross-sectional area for positioning generally normal or perpendicular to the direction of movement of shaft 44 is the water. Water-impingement surfaces 56 and 58 hydrodynamically engage the water as exercise assembly 42 is moved in or through the water.

The diameter of the outer shell's water-impingement surface 56 is substantially greater than the width of shaft 44 to increase or intensify the water resistance of outer whell 46. In the preferred form of ball-type of exercise assembly 42 (FIGS. 4 and 5), internal ball 48 is slightly smaller than outer shell 46 and has a circular cross-sectional area of a diameter substantially greater than the width of shaft 44 to enhance the water resistance of the hydrodynamic resistance assemblies 54 and 55.

The outer shell 46 and internal ball 48 of each hydrodynamic resistance assembly 54 and 55 are spaced an effective distance from the manually grippable handle portion 60 of shaft 44 to exert a hydrodynamic torque on the handle portion 60 as shaft 42 is moved in or through the water. If the user's hands are held in the middle of shaft 44 and the shaft is rotated or pivoted, the torque exerted by each hydrodynamic resistance assembly 54 and 5555 counterbalance and offset each other.

The ball type of aquatic exercise assembly 42 (FIGS. 4 and 5) provides many similar advantages as the blade-type of aquatic exercise assembly 20 (FIGS. 1–3) and is used in a similar manner. As shaft 44 is moved or swung in the water, internal balls 48 rotate and spin within the interior of shells 46.

Figure 6:
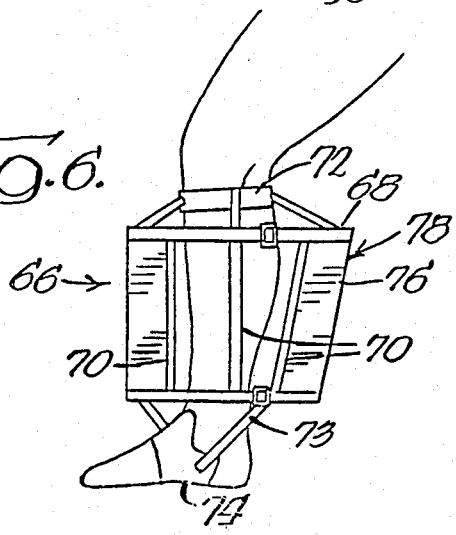
FIG. 6 is a perspective view of a blade-type aquatic exercise assembly that has been strapped onto the user's leg.

The blade or fin type of aquatic leg exercise assembly 66 shown in FIG. 6 is similar in many respects to the blade-type aquatic exercise assembly shown in FIGS. 1–3. Leg exercise assembly 66 has a flexible frame structure or assembly 68 connected to a plurality of elongated circumferentially spaced, generally upright shafts or bars 70. Frame 68 has an upper flexible strap 72 for connection to the person's leg and has lower flexible straps 73 connected to a stirrup 74 that fits upon the person's foot. Straps 72 and 73 and shafts 70 provide manually grippable handle portions which are readily graspable by the user of the leg exercise assembly 66. Each upright shaft 70 is axially connected to a generally upright water-engageable blade or fin 76. Each blade is preferably generally flat or planar with a rectangular shape. In some circumstances, however, it may be desirable that the blades be curved or of a different configuration. Collectively, blades 76 provide a hydrodynamic resistance assembly 78 to deflect water and create a pressure head and fluid resistance to water flow as the exercise assembly 66 is moved in the water.

Figure 7:
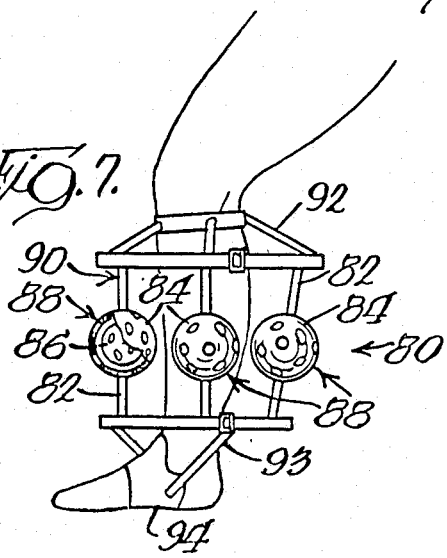
FIG. 7 is a perspective view of a ball-type aquatic leg exercise assembly that has been strapped onto the user's leg.

The ball-type of aquatic leg exercise assembly 80 shown in FIG. 7 is similar to the blade-type of aquatic exercise assembly 66 shown in FIG. 6, except that each shaft or bar 82 securely carries at least one water-engageable hollow outer shell 84 that houses an internal hollow ball 86. Each outer shell 84 and internal ball 86 are structurally and functionally similar to the shells 46 and balls 48, respectively, of the barbell-like exercise assembly 42 shown in FIGS. 4 and 5, and provide a hydrodynamic resistance assembly 88. Frame 90, straps 92 and 93 and stirrup 94, respectively, are substantially identical to the frame 68, straps 72 and 73 and stirrup 74, respectively, shown in FIG. 6.

Figures 8, 9, 10, 11, 12, 13:
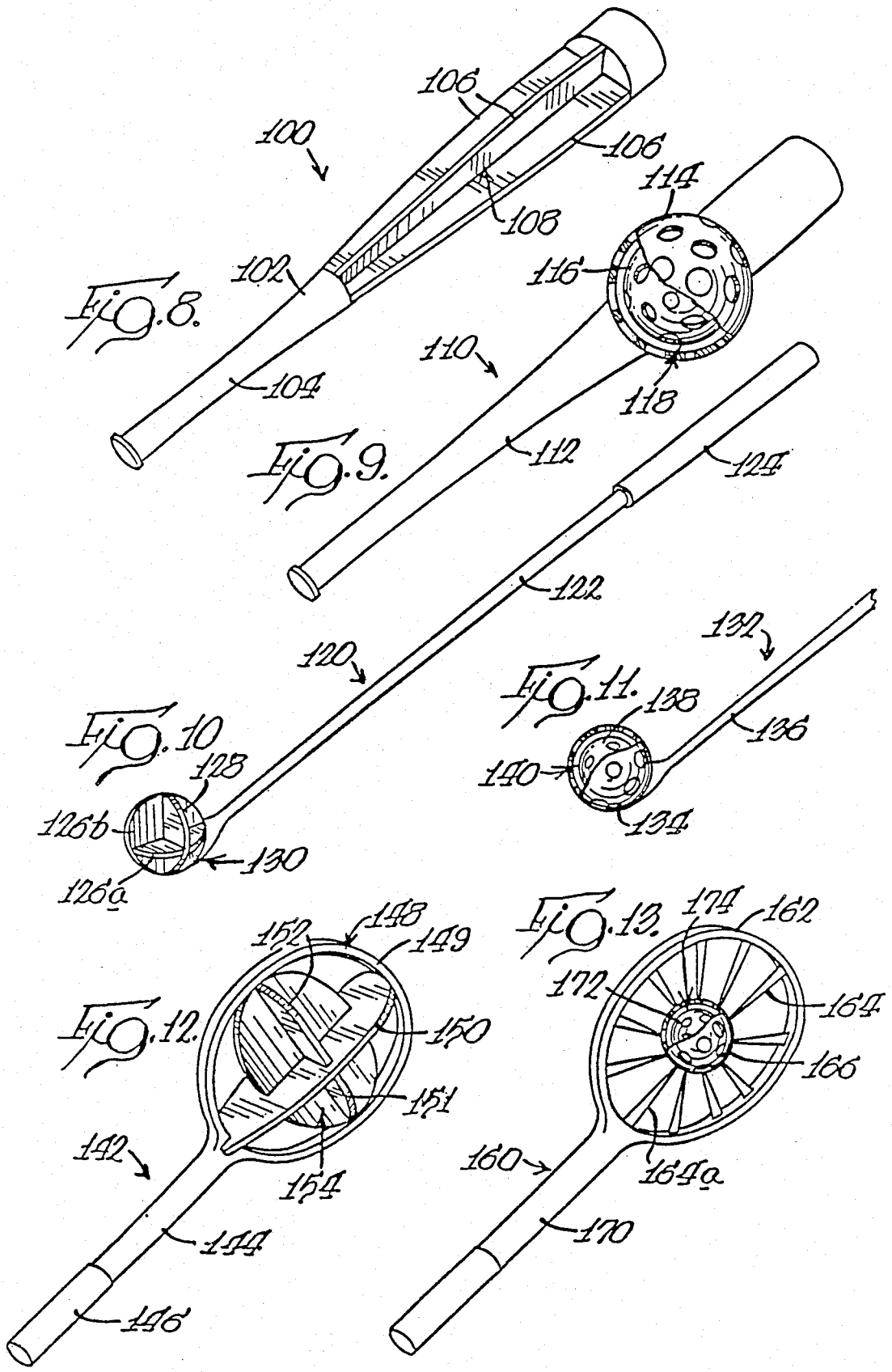
FIG. 8 is a perspective view of a bat-like blade-type of aquatic exercise assembly.
FIG. 9 is a perspective view of a bat-like ball-type of aquatic exercise assembly with portions shown in cross-section.
FIG. 10 is a perspective view of a golf club-like blade type of aquatic exercise assembly.
FIG. 11 is a fragmentary perspective view of a golf club-like ball-type of aquatic exercise assembly with portions shown in cross-section.
FIG. 12 is a perspective view of a raquet-like blade type of aquatic exercise assembly.
FIG. 13 is a perspective view of a racquet-like ball type of aquatic exercise assembly.

The bat-like blade-type of aquatic exercise assembly 100 of FIG. 8 has a generally solid water-engageable shaft 102. Shaft 102 is in the form of a baseball bat or club with a manually grippable handle portion 104. Exercise assembly 100 has two sets of diametrically opposed generally flat blades or fins 106 that provide a hydrodynamic resistance assembly 108. Blades 106 are tapered inwardly towards handle 104 and are positioned at right angles to each other. Blades 106 operate in the water similarly to the radial blades 32 of the barbell-type of aquatic exercise assembly 20 shown in FIGS. 1–3. If desired, curved blades, or blades having a different shape, or blades positioned at a different angular relationship can be used.

The bat-like ball-type of aquatic exercise assembly 110 shown in FIG. 9 is similar to the bat-like aquatic exercise assembly 100 shown in FIG. 8, except that the outer end of the bat-like water-engageable shaft 112 securely carries a water-engageable hollow outer shell 114 that houses an internal hollow ball 116. Outer shell 114 and internal ball 116 are structurally and functionally similar to shells 46 and ball 48, respectively, of the exercise assembly 42 shown in FIG. 4 and 5, and cooperate together to provide a hydrodynamic resistance assembly 118.

The golf club-like blade-type of aquatic exercise assembly 120 shown in FIG. 10 has an elongated water-engageable shaft or shank 122 in the form of a golf club with a manually grippable handle portion 124 and blades or fins **126*a*, 126*b*, and 128 that cooperate with each other to provide the head of the club. The blades include a semi-circular axial blade 126*a* and a generally circular axial blade 126*b*, that are positioned at right angles to each other, as well as a transverse semi-circular blade 128. The transverse blade 128 abuts against, intersects, and is positioned generally normal to axial blades 126*a* and 126*b*. Blades 126*a*, 126*b*, and 128 cooperate with each other to provide a hydrodynamic resistance assembly 130 and function similarly to blades 32 and 40, respectively, of the exercise assembly 20 shown in FIGS. 1–3**.

The golf club-like ball-type of aquatic exercise assembly 132 of FIG. 11 is similar to the golf club-like aquatic exercise assembly 120 of FIG. 10, except that the head at the end of shaft or shank 136, contains a water-engageable hollow outer shell 134 that houses an internal hollow ball 138, in lieu of blades. Outer shell 134 is securely connected to the end of shaft 136, while internal ball 138 is free to rotate and spin within the interior of shell 138 as the exercise assembly 132 is moved in the water. Outer shell 134 and internal ball 138 are structurally and functionally similar to the shells 46 and ball 48, respectively, of exercise assembly 42 (FIGS. 4 and 5) and cooperate with each other to provide a hydrodynamic resistance assembly 140.

The racquet-like blade-type of aquatic exercise assembly 142 shown in FIG. 12 has a shaft or shank 144 in the form of a racquet with a manually grippable handle portion 146 and a racquet-like head 148. Racquet-like aquatic exercise assembly 142 can be in the form of a tennis racquet, racquetball racquet, lacrosse racquet, squash racquet, jai alai racquet, paddle, etc. Head 148 has an elliptical rim 149 that is connected to two water-engageable generally elliptical axial blades or fins 150 and 151, and a generally elliptical transverse fin 152. Axial blade 150 is secured to the upper end of shaft 144 and spans a greater length than the other blades 151 and 152. Blades 150, 151, and 152 function similarly to blades 32 and 49, respectively, of the exercise assembly 20 shown in FIG. 1–3 and provide a hydrodynamic resistance assembly 154.

Referring now to FIG. 13, the racquet-like ball-type of aquatic exercise assembly 160 shown therein is similar to the racquet-like blade-type of aquatic exercise assembly 142 show in FIG. 12, except that racquet head 162 has radial spokes 154 that are secured to a water-engageable hollow outer shell 166, in lieu of blades. Outer shell 166 is axially secured to shaft or shank 170, via axial spoke **164*a*, and houses an internal hollow ball 172. Outer shell 166 and internal ball 172 are structurally and functionally similar to the shells 46 and balls 48, respectively, of exercise assembly 42 of FIGS. 4 and 5, and cooperate with each other to provide a hydrodynamic resistance assembly 174**.

Referring now to FIGS. 14–16, the barbell-like or dumb bell-like blade-type aquatic exercise assembly 176 shown therein provides an aquatic dumb bell which is similar to the barbell-like aquatic exercise assembly 20 of FIGS. 1–3, except that the radial fins 178 have axial engaging portions 180 extending across their entire length which are secured to and touch each other in coaxial alignment with the axis 182 of shaft 184 and are secured to and extend radially outwardly of fin-engageable end portions or butts 186 and 188 at the end of the shaft. Fin-engageable end portions 186 and 188 have a transverse diametric thickness or height greater than the manually grippable portion 190 of shaft 182. Transverse fins or end plates 92 abut flush against and are secured to the outer transverse radial edges 194 of radial fins 178.

In the embodiment shown in FIGS. 14–16, transverse fins 192 are circular and radial fins 178 are the shape of a quadrant or a quarter of a circle. End portions 186 and 88 of shaft 184 are circular discs, and shaft 184 is cylindrical. Circular fins 192 can have flat portions 86 (FIG. 16) which are spaced apart from each other to minimize rolling when the exercise assembly is laid on the floor or a pool deck. Transverse and radial fins 192 and 178, as well as end portions 186 and 188, can also be rectangular, preferably square, with rounded corners to avoid scratching or accidentally puncturing the skin and to enhance safety. Shaft 184 can have a square or polygonal cross-section and can be solid or tubular.

Fins 178 and 192 each have generally planar or flat, imperforate, water-impingement surfaces which provide solid, water impermeable cross-sectional areas or barriers. The maximum height of radial fins 178 are more than twice the maximum thickness of the manually grippable portion 90 of shaft 184. Transverse fin 192 spans a distance at least as great as the maximum diametric span or height of the radial fins 178 and occupies an area enclosing the radial fins.

In the embodiment shown in FIGS. 14–16, there are two sets of diametrically opposed radial fins 178 at each end of the shaft 184 which are positioned generally at right angles to each other to define angular aquatic pockets to cuppingly engage water as the aquatic exercise assembly is moved in the water. It may be desirable in some circumstances that there be more or less radial fins, or that the radial fins be spaced at greater or less than at right angles to each other, or that the radial fins be curved or twisted or have some other shape. Auxiliary fins can be bolted, clamped or otherwise secured to the radial fins and transverse fins to increase the effective height of the fins. The aquatic exercise assembly 176 can come in various sizes with larger sizes for man and more compact and smaller sizes for women and children.

The aquatic exercise assembly 198 shown in FIGS. 17–19 is substantially similar to the exercise assembly 176 shown in FIGS. 14–16, except that the radial fins 178 are secured to only one end, end portion 188, of shaft 184. Shaft 184 and fins 178 can be very long or relatively short with respect to each other depending on the preference of the user. Exercise assembly 176 provides an aquatic bat for a baseball player, an aquatic tennis racquet for a tennis player, an aquatic racquetball racquet for a racquetball player, and an aquatic golf club for a golfer.

Figure 20:
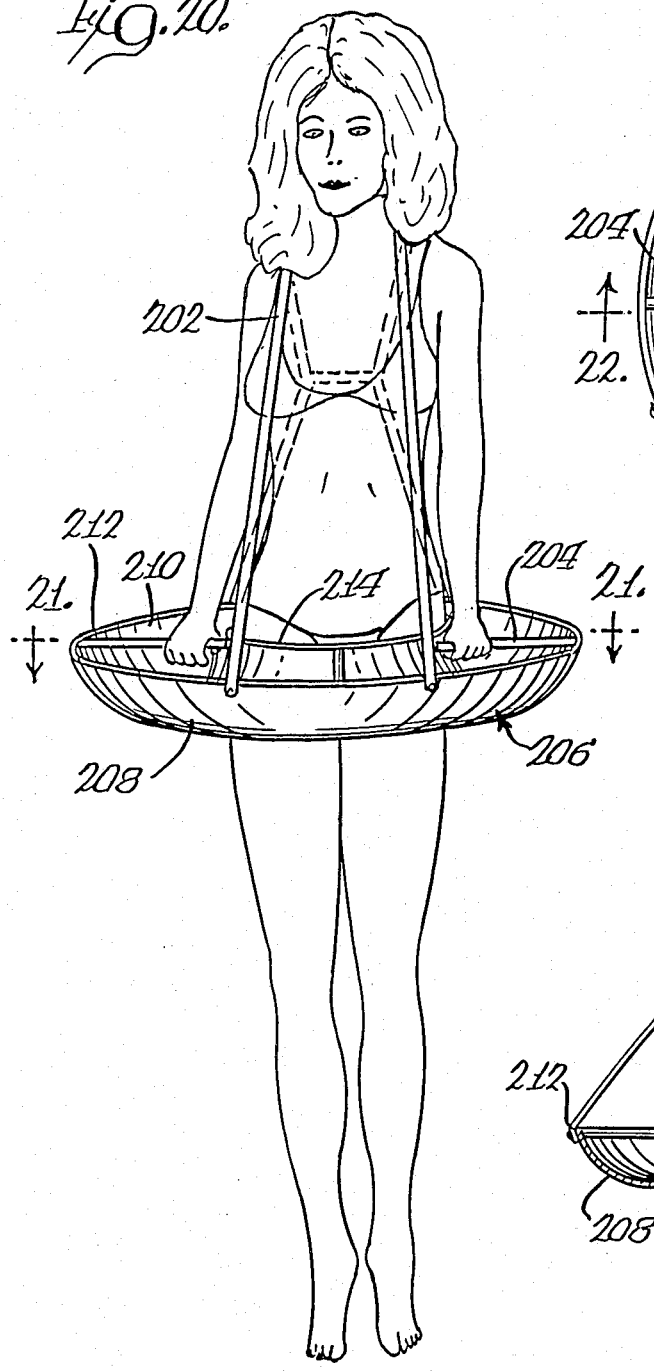
FIG. 20 is a perspective view of a jumper aquatic exercise assembly being held by a woman in accordance with principles of the present invention.

The jumper aquatic exercise assembly 200, also referred to as a hydrodynamic jumper, squatter or hoop, shown in FIG. 20 is used by athletes, exercisers, patients, parapalegics, and other persons desirous of strengthening their thigh and back muscles, improving muscle tone in their legs and enhancing muscular coordination. It can be used by men, women and children alike, without changing, adding, or removing parts and components, by simply adjusting the height of the shoulder straps 202. In use, the jumper aquatic exercise assembly 200 is held by the manually grippable handles 204 while repetitively squatting or doing knee bends underwater. The jumper aquatic exercise assembly is helpful to improve the cardiovascular system and physical well being of the user. By controlling the rate of ascent or descent of the jumper aquatic exercise assembly in the water, the magnitude of the hydrodynamic resistive forces exerted by the exercise assembly on the user can be regulated to the desired amount, while minimizing harsh impact forces and shock on the user's joints and muscles.

The adjustable shoulder straps or suspenders 202 of the hydrodynamic jumper 200 provide a harness assembly which is connected to an annular hydrodynamic hoop-like member 204 by bolts, eyelets, or other fasteners. If desired, in lieu of fasteners, the straps can be tied or adhesively bonded with marine adhesive or water resistant glue to the annular member 202. The straps should be adjusted so that the annular member is positioned about the user's waist. The straps can be made of silicone rubber, plastic or a fabric impregnated or coated with a water proofing material, and can include one or more buckles. The annular member is water impermeable and preferably made of rigid, impact resistant plastic, such as polypropylene. Other types of plastics can be used, as can light weight noncorrosive metals, such as aluminum.

Figure 21:
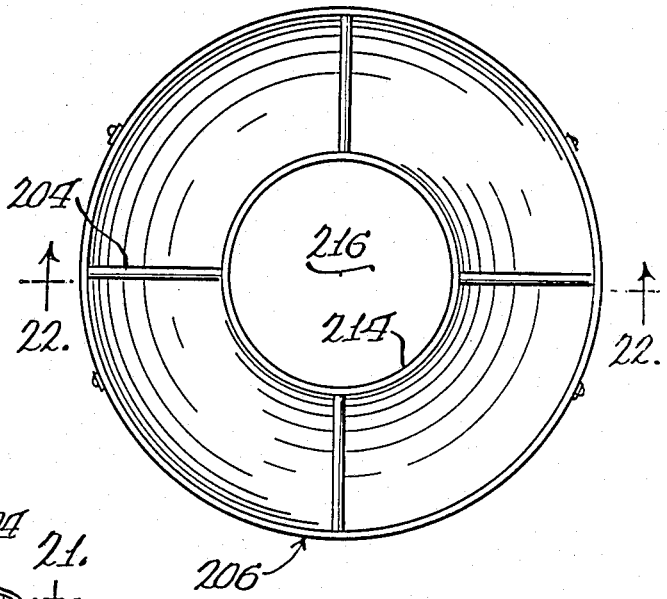
FIG. 21 is a top plan view of the jumper aquatic exercise assembly of FIG. 20.
Figure 22:
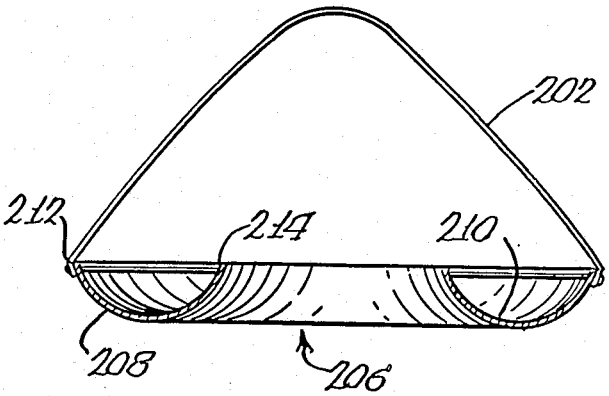
FIG. 22 is a cross sectional view of the jumper aquatic exercise assembly of FIG. 21 taken substantially along line 22—22 of FIG. 21.

In the embodiments of FIGS. 20–22, the annular member 206 has a semi-torroidal, convex, downwardly facing water-engageable surface 208, which is donut-shaped or bagel-shaped as viewed from the bottom, with a U-shaped cross-section, and has a concave upwardly facing, water-engageable surface 210. The annular member has a circular outer peripheral edge or rim 212, and a circular inner edge 214 which are of the same height so as to be in horizontal alignment with each other. The inner edge 214 defines a circular waist-receiving access opening 216 (FIG. 21). Because of the particular shape and arrangement of the annular member, the upwardly facing surface exerts a substantially greater hydrodynamic fluid resistive force, drag and pressure head on the user, when the jumper aquatic exercise assembly is raised or lifted in the water, than that exerted by the downwardly facing surface when the jumper aquatic exercise assembly is lowered deeper in the water.

There are four manually grippable handles 204 in the embodiment of FIGS. 20–22. Handles 204 extend radially between and connect the circular outer and inner edges 212 and 214, respectively, and help reinforce and rigidify the annular member. In some circumstances, it may be desirable to use more handles or as few as two handles, or other shaped handles, such as upwardly extending knobs, etc.

Figure 23:
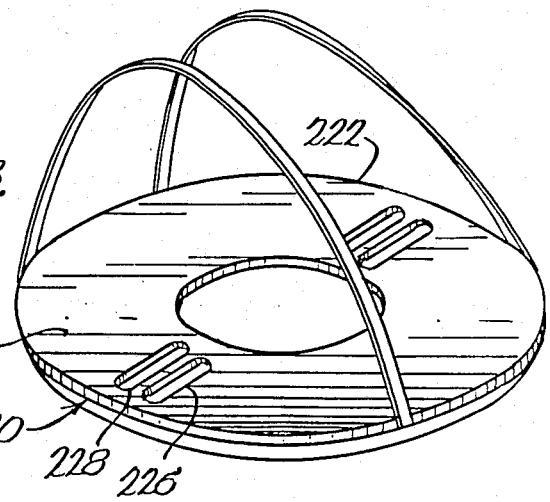
FIG. 23 is another jumper aquatic exercise assembly in accordance with principles of the present invention.

The jumper aquatic exercise assembly or hydrodynamic jumper 220 shown in FIG. 23 is substantially the same as the jumper aquatic exercise assembly of FIGS. 20–22, except that the annular hydrodynamic member 222 has a generally planar or flat top surface 224. Annular member 222 is generally hollow with hand holes 226 on both sides of each radial manually grippable handle.

Figure 24:
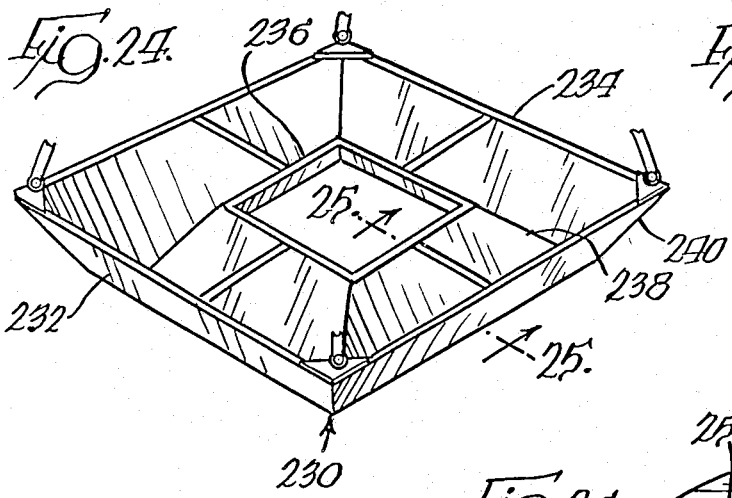
FIG. 24 is a fragmentary perspective view of a trough-shaped jumper aquatic exercise assembly in accordance with principles of the present invention.
Figure 25:
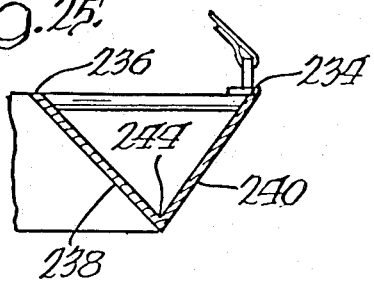
FIG. 25 is a cross-sectional view of the trough-shaped jumper aquatic exercise assembly taken substantially along line 25—25 of FIG. 24.

The jumper aquatic exercise assembly or hydrodynamic jumper 230 shown in FIGS. 24 and 25 is similar to the jumper aquatic exercise assembly 200 of FIGS. 20–22, except that the annular hydrodynamic member 232 is generally trough-shaped with a square outer peripheral edge 234 and a square inner edge 236. Square inner edge defines a square waist-receiving access opening. The annular member has trapezoidal shaped, flared inner sidewalls 238 which slope downwardly and outwardly, and inverted trapezoidal shaped, flared outer sidewalls 240 which extend and slope upwardly and outwardly from the bottom edge 242 (FIG. 25) of the inner wall 238. As shown in FIG. 25, the inner and outer walls cooperate with each other to define elongated upwardly facing, V-shaped pockets 244 with acute, V-shaped upwardly facing, water-engageable surfaces, and provide oblique downwardly facing water-engageable surfaces. Because of its trough shape, the upwardly facing surfaces of the annular member exerts a substantially greater hydrodynamic fluid resistive force, drag and pressure head on the user when raised or lifted in the water, than that exerted by the downwardly facing surfaces when lowered in the water.

Figure 26:
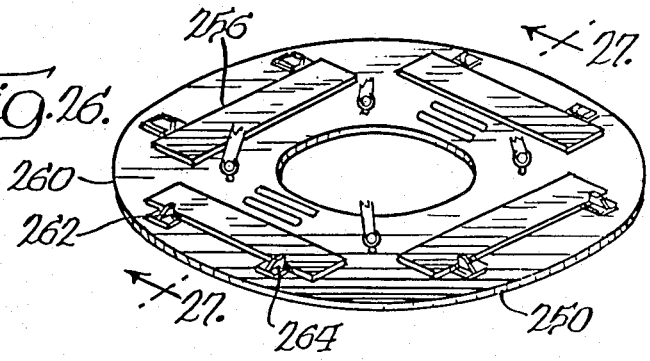
FIG. 26 is a fragmentary perspective view of a further jumper aquatic exercise assembly with pivotable flaps in accordance with principles of the present invention.
Figure 27:
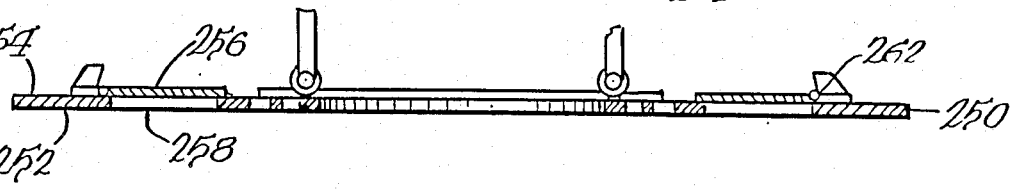
FIG. 27 is a cross-sectional view of the jumper aquatic exercise assembly of FIG. 26 taken substantially along line 27—27 of FIG. 26.
Figure 28:
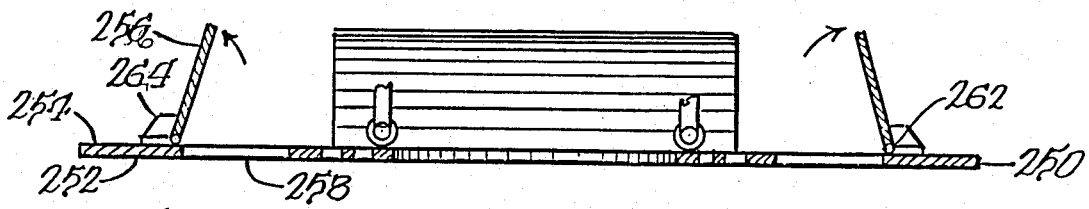
FIG. 28 is a cross-sectional view similar to FIG. 27, but showing the flaps moving upward as the jumper aquatic exercise assembly is lowered in the water.

The jumper aquatic exercise assembly or hydrodynamic jumper 250 shown in FIGS. 26–28 is similar to the jumper aquatic exercise assembly 220 shown in FIG. 23, except that the downwardly facing bottom surface 252 is generally planar or flat, as is the upwardly facing top surface 254, and a series of flaps 256 pivotally cover a set of fluid flow passageways or holes 258. It is preferred that the open area occupied by the holes are as large as practicable while preserving the structural integrity of the annular member 260 to minimize drag and fluid resistance when moving the jumper downwardly underwater. In the embodiment of FIGS. 26–28, there are four rectangular flaps 256 which cover four rectangular holes 258. The flaps are pivotally connected to the top surface 256 of the annular hydrodynamic member 260 by hinges 262. The hinges are fastened or bonded to the flaps and top surface. Stops or blocks 264 prevent the flaps from pivoting more than 90 degrees, so as to prevent the flaps from bending past a vertical position when the jumper is moved underwater. In the illustrative embodiment, the stops hold the flaps to a generally upright open position, slightly less than 90 degrees relative to the top surface 254, when the jumper is moved downwardly underwater, so that it is easier for the flaps to pivot downwardly to their closed position when the jumper is moved upwardly underwater. In some circumstances it may be desirable to use more or less flaps or holes and/or other shaped flaps or holes.

In use when the jumper aquatic exercise assembly 250 is raised in the water, the flaps 256 will pivot to a horizontal closed position covering the holes 258, as shown in FIG. 27, to increase the hydrodynamic fluid resistive forces, drag and pressure head exerted on the user by the annular member. When the jumper aquatic exercise assembly 250 is lowered in the water, the flaps 256 pivot to a generally open position, slightly less than 90 degrees, as shown in FIG. 28, to permit water to flow through holes 258, thereby minimizing and decreasing the hydrodynamic forces, drag and pressure head exerted by the annular member on the user.

Figure 29:
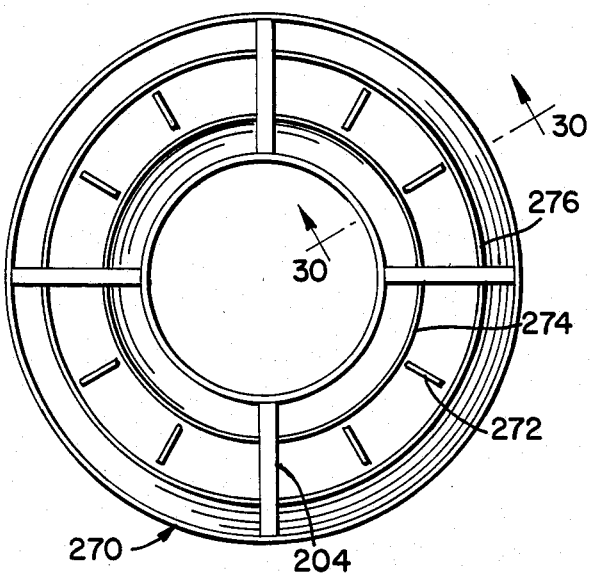
FIG. 29 is a top plan view of a jumper aquatic exercise assembly equipped with resistant blades in accordance with principles of the present invention.
Figure 30:
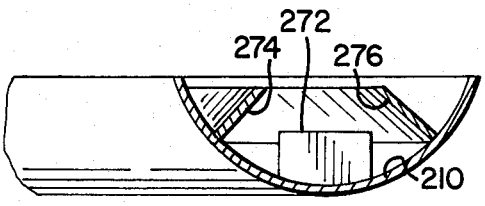
FIG. 30 is a cross-sectional view of the jumper aquatic exercise assembly of FIG. 30 taken substantially along line 30—30 of FIG. 29.

The jumper aquatic exercise assembly or hydrodynamic jumper 270 shown in FIGS. 29 and 30 is structurally and functionally similar to the hydrodynamic jumper 206 shown in FIGS. 20–22, except that the jumper has radial and concentric circular or circumferential water-resistant turbulant blades, baffles, or deflectors 272, 274 and 276, respectively, with a rectangular cross-section for increased hydrodynamic water resistance, pressure and turbulence as the jumper is moved upwardly in the water.

Figure 31:
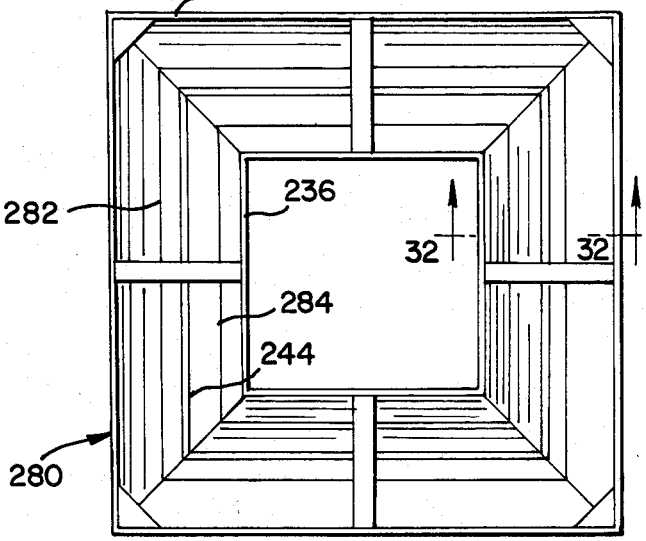
FIG. 31 is a top plan view of another jumper aquatic exercise assembly with other resistant blades in accordance with principles of the present invention.
Figure 32:
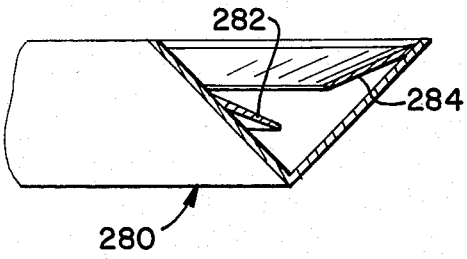
FIG. 32 is a cross-sectional view of the jumper aquatic exercise assembly of FIG. 31 taken substantially along line 32—32 of FIG. 31.

The jumper aquatic exercise assembly or hydrodynamic jumper 280 shown in FIGS. 31 and 32 is structurally and functionally similar to the hydrodynamic jumper 230 shown in FIGS. 24 and 25, except that the jumper has coaxial concentric rectangular water resistant turbulant blades, baffles, or deflectors 282 and 284 for increased hydrodynamic water resistance, pressure and turbulence as the jumper is moved upwardly in the water. The blades or baffles of FIGS. 31 and 32 have a triangular cross-section and have rectangular inner and outer peripheries as viewed from the top.

The blades or baffles of FIGS. 29–32 extend upwardly or inwardly from the upwardly facing surfaces of the jumper at an angle ranging from 15 degrees to 90 degrees. In FIGS. 29 and 30 the blades are perpendicular to the curved upwardly facing surface 210 of the jumper. In FIGS. 31 and 32 the blades extend inwardly at an acute angle of 30 degrees from the upwardly facing walls of the jumper.

Figure 33:
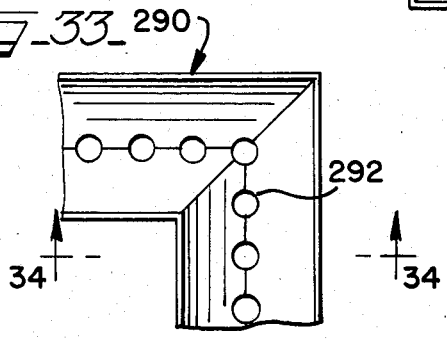
FIG. 33 is a fragmentary top plan view of a perforated jumper aquatic exercise assembly in accordance with principles of the present invention.
Figure 34:
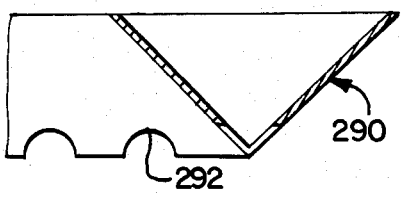
FIG. 34 is a cross-sectional view of the perforated jumper aquatic exercise assembly taken substantially along line 34—34 of FIG. 33.

The jumper aquatic exercise assembly or hydrodynamic jumper 290 of FIGS. 33 and 34 is structurally and functionally similar to the hydrodynamic jumper 230 of FIGS. 31 and 32, except that the jumper has holes, apertures, flow passageways or slits 292 for less or greater water resistance and hydrodynamic pressure depending on the size of the holes, as the jumper is moved upwardly and downwardly in the water.

Figure 35:
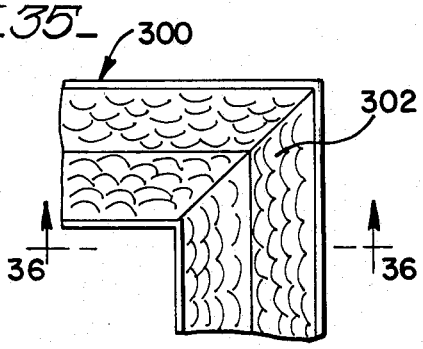
FIG. 35 is a fragmentary top plan view of a jumper aquatic exercise assembly with wavy bumpy surfaces in accordance with principles of the present invention.
Figure 36:
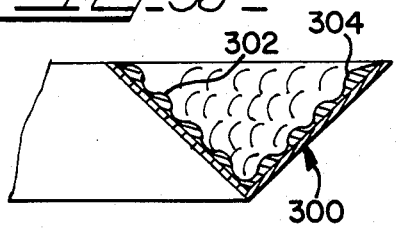
FIG. 36 is a cross-sectional view of the jumper aquatic exercise assembly of FIG. 35 taken substantially along line 36—36 of FIG. 35.

The jumper aquatic exercise assembly or hydrodynamic jumper 300 of FIGS. 35 and 36 is structurally and functionally similar to the hydrodynamic jumper 230 of FIGS. 31 and 32, except that the jumper has a wavy, bumpy upwardly facing V-shaped surface 302 with bumps or humped, rounded, or curved protruberences 304 for increased hydrodynamic water resistance, pressure and turbulence as the jumper is moved upwardly in the water.

Figure 37:
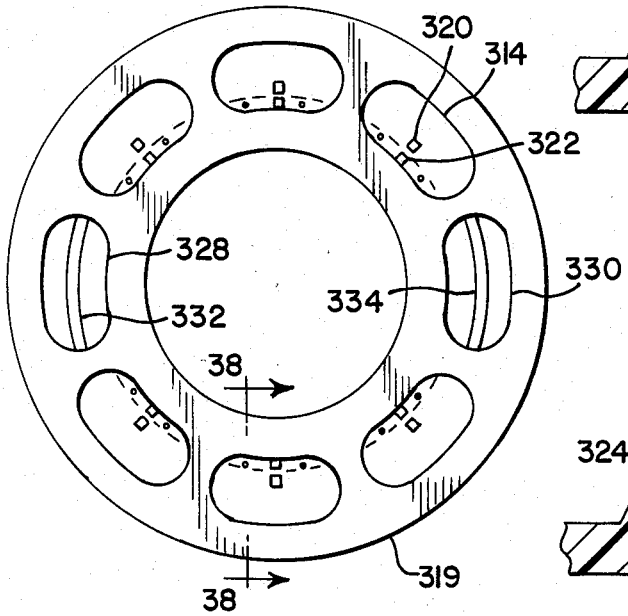
FIG. 37 is a top plan view of another jumper aquatic exercise assembly with pivotable flaps in accordance with principles of the present invention.
Figure 38:
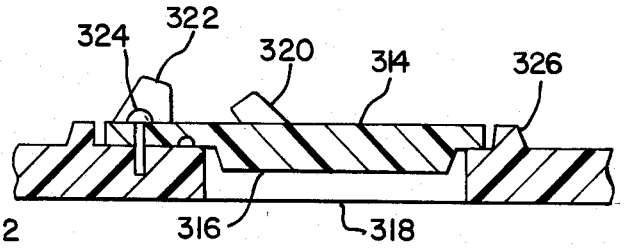
FIG. 38 is a cross-sectional view of the jumper aquatic exercise assembly of FIG. 37 taken substantially along line 38—38 of FIG. 37 and showing the flaps in a closed position.
Figure 39:
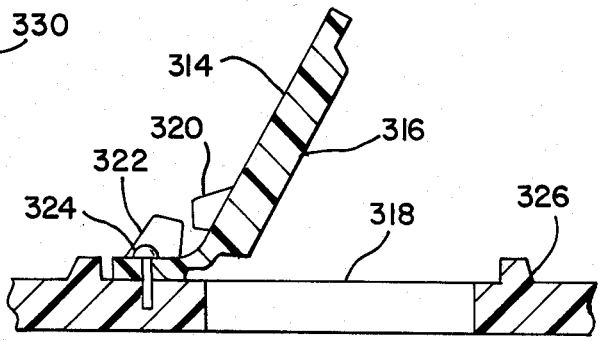
FIG. 39 is a cross-sectional view similar to FIG. 38, except with the flaps in a partially open position.

The jumper aquatic exercise assembly or hydrodynamic jumper shown in FIGS. 37–39 is structurally and functionally similar to the hydrodynamic jumper shown in FIGS. 26–28, except that it has oval elliptical flaps 314 with downwardly extending sealing plugs, sockets, or seals 316. The sealing plugs fit into and seal the oval elliptical holes 318 or flow passageways of the annular member 319 when the flaps are closed as shown in FIG. 38 in response to the jumper being moved upwardly in the water. The flaps have bumpers or stops 320 and 322 which are securely attached to the flaps by marine adhesive, bolts 324 or other fasteners to limit the maximum angle of opening of the flaps as shown in FIG. 39 to a predetermined amount less than 90 degrees, preferably from 75 to 85 degrees, to keep the flaps off top dead center when the jumper moves downwardly in the water. The bumpers assure that the flaps move properly downwardly into and close the holes 318 when the jumper moves upwardly. The bumpers also serve as water-resistant baffles or deflectors. The flaps can be surrounded by an annular oval flange or ridge 326 for sidewise protection of the flaps. The jumper of FIG. 37 has oval elliptical hand holes 328 and 330 with hand rails, grips, or handles 332 and 334.

Figure 40:
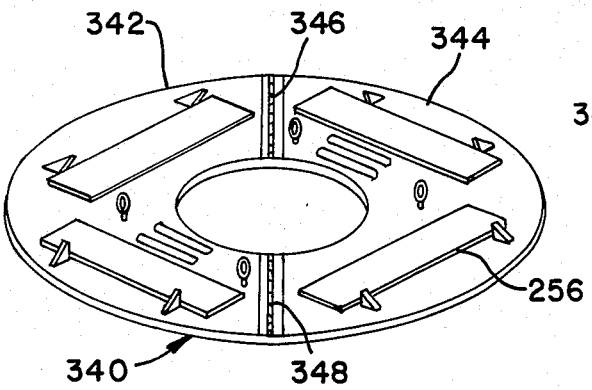
FIG. 40 is a perspective view of a foldable hinged aquatic exercise assembly in accordance with principles of the present invention.
Figure 41:
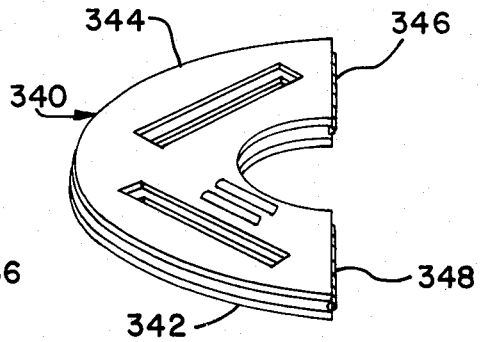
FIG. 41 is a perspective view of the foldable hinged aquatic exercise assembly in a folded position.

The jumper aquatic exercise assembly or hydrodynamic jumper 340 shown in FIGS. 40 and 41 is structurally and functionally similar to the hydrodynamic jumper shown in FIGS. 26–28, except that the jumper has foldable collapsable sections 342 and 344 which are connected by hinges 346 and 348. The hinged sections can be folded for easy compact storage, shipment and handling. The other jumpers described above can also have two or more foldable hinged sections for easier compact storage, shipment and handling.

The jumpers described above are preferably made of substantially rigid, imperforate water-impervious material, such as impact resistant plastic or aluminum. Other materials can be used, if desired.

Additional weight can be added to the jumpers, such as by constructing the trough-shaped jumper with a heavy metal V-shaped bottom or by constructing any of the previously described jumpers with heavy metal handles to help lower the jumper in the water at a faster rate.

Each of the preceding embodiments provide a wider range of movement in water with less stress on the joints of the user than is attainable with most types of conventional barbells and other exercise devices that are used on land and offer many advantages to physical therapists.

Although embodiments of the invention have been shown and described, it is to be understood that various modifications and substitutions can be made by those skilled in the art without departing from the novel spirit and scope of this invention.

What is claimed is:

1. A jumper aquatic exercise assembly for use in repetitively squatting and doing knee bends underwater to strengthen muscles and improve muscle tone in the user's legs, comprising:

a substantially rigid annular hydrodynamic member extending substantially continuously and laterally away from and about the waist of the user defining a waist-receiving opening, said annular member having a substantially rigid annular, downwardly facing surface descendingly engaging the water and creating substantial hydrodynamic fluid resistance and a downward pressure head when said annular member is lowered in the water and a substantially rigid annular, upwardly facing surface for ascendingly engaging the water and creating hydrodynamic fluid resistance and an upward pressure head when said rigid member is raised in the water;

flexible strap means operatively connected to said annular member for supporting said annular member from the user's shoulders generally about the waist of the user; and substantially rigid fluid resistance enhancing means positioned symmetrically about and extending integrally from said rigid annular hydrodynamic member for increasing the hydrodynamic fluid resistance and pressure head of said rigid annular member when said rigid annular member is raised in the water.

2. A jumper aquatic exercise assembly in accordance with claim 1 where said fluid resistance enhancing means includes a plurality of annular concentric baffles extending upwardly from said upwardly facing member at an angle ranging from about 15 degrees to about 90 degrees.

3. A jumper aquatic exercise assembly in accordance with claim 2 wherein said baffles includes radial blades extending radially between said concentric baffles.

4. A jumper aquatic exercise assembly in accordance with claim 3 wherein said radial blades have a rectangular cross-section.

5. A jumper aquatic exercise assembly in accordance with claim 2 where said concentric baffles have a triangular cross-section with a substantially rectangular inner periphery and a substantially rectangular outer periphery as viewed from above said upwardly facing surface.

6. A jumper aquatic exercise assembly in accordance with claim 3 wherein said downwardly facing surface is convex and said upwardly facing surface is concave.

7. A jumper aquatic exercise assembly in accordance with claim 1 wherein said annular hydrodynamic member is generally trough shaped, said upwardly facing surface comprises a substantially bumpy V-shaped surface, and said fluid resistance enhancing means comprises humped rounded protuberances extending upwardly from said V-shaped surface.

8. A jumper aquatic exercise assembly for use in repetitively squatting and doing knee bends underwater to strengthen muscles and improve msucle tone in the user's legs, comprising:

an annular hydrodynamic member defining a waist-receiving opening, said annular member having a generally downwardly facing surface for descendingly engaging the water and creating substantial hydrodynamic fluid resistance and a downward pressure head when said annular member is lowered in the water and a generally upwardly facing surface for ascendingly engaging the water and creating hydrodynamic fluid resistance and an upward pressure head when said annular member is raised in the water;

strap means operatively connected to said annular member for supporting said annular member from the user's shoulders generally about the waist of the user;

fluid resistance enhancing means for increasing the hydrodynamic fluid resistance and pressure head of said annular member when said annular member is raised in the water;

said annular hydrodynamic member defining elliptical holes and having a plurality of elliptical flaps pivotally connected to said upwardly facing surface, said flaps each having a downwardly extending sealing plug for allowing water to pass through said elliptical holes in response to said annular hydrodynamic member being lower in the water to a generally horizontal position for covering said flow passageways in response to said annular hydrodynamic member being raised in the water; and said fluid resistance enhancing means including bumpers attached to said flaps for limiting the angle of opening of said flaps.

9. A jumper aquatic exercise assembly in accordance with claim 8 wherein said annular member includes foldable sections which are hingeably connected to each other for compact storage, shipment, and handling.

* * * * *